US008845276B2

(12) United States Patent
Van Der Meijden et al.

(10) Patent No.: US 8,845,276 B2
(45) Date of Patent: Sep. 30, 2014

(54) FLUID-POWERED MOTORS AND PUMPS

(75) Inventors: Hendrikus Johannes Van Der Meijden, Midrand (ZA); Michael Edward Moore, Johannesburg (ZA)

(73) Assignee: Zodiac Pool Systems, Inc., Vista, CA (US)

( * ) Notice: Subject to any disclaimer, the term of this patent is extended or adjusted under 35 U.S.C. 154(b) by 636 days.

(21) Appl. No.: 12/564,997

(22) Filed: Sep. 23, 2009

(65) Prior Publication Data

US 2010/0119358 A1 May 13, 2010

Related U.S. Application Data

(60) Provisional application No. 61/192,927, filed on Sep. 23, 2008.

(51) Int. Cl.

| | |
|---|---|
| ***F04D 29/36*** | (2006.01) |
| ***F01C 1/36*** | (2006.01) |
| ***F01C 3/02*** | (2006.01) |

(52) U.S. Cl.
CPC .... *F01C 1/36* (2013.01); *F01C 3/02* (2013.01)
USPC ..... 415/125; 415/174.2

(58) Field of Classification Search
USPC ..... 15/1.7; 415/2.1, 3.1, 4.2, 4.4, 125, 140, 415/141, 174.2, 991; 416/99, 100, 103, 416/112, 127
See application file for complete search history.

(56) References Cited

U.S. PATENT DOCUMENTS

| | | | | |
|---|---|---|---|---|
| 333,607 | A * | 1/1886 | Cummings | 416/112 |
| 397,118 | A * | 2/1889 | Fox | 415/125 |
| 2,557,427 | A | 6/1951 | Gibson | |
| 2,584,582 | A | 2/1952 | Hatfield | |
| 3,895,893 | A * | 7/1975 | Sommer | 418/153 |
| 4,449,265 | A | 5/1984 | Hoy | |
| 5,156,541 | A | 10/1992 | Lew | |
| 5,197,158 | A * | 3/1993 | Moini | 15/1.7 |
| 6,292,970 | B1 * | 9/2001 | Rief et al. | 15/1.7 |
| 6,981,839 | B2 * | 1/2006 | Fan | 415/4.1 |
| 2004/0261757 | A1 | 12/2004 | Nathan et al. | |

FOREIGN PATENT DOCUMENTS

| | | |
|---|---|---|
| FR | 2870883 | 12/2005 |
| GB | 341013 | 1/1931 |

OTHER PUBLICATIONS

International Search Report for PCT/IB2009/006809 dated Jul. 16, 2010.

* cited by examiner

*Primary Examiner* — Richard Edgar
*Assistant Examiner* — Ryan Ellis
(74) *Attorney, Agent, or Firm* — Dean W. Russell; Kilpatrick Townsend & Stockton LLP

(57) ABSTRACT

Fluid-powered devices are detailed. The devices may be utilized as motors or pumps, for example, and are capable to switching dynamically between these functions. They additionally may use surface-area, rather than solely pressure, differentials to produce rotary motion.

2 Claims, 5 Drawing Sheets

FLUID-POWERED MOTORS AND PUMPS

REFERENCE TO PROVISIONAL APPLICATION

This application is based on, claims priority to, and hereby refers to U.S. Provisional Patent Application Ser. No. 61/192,927, filed Sep. 23, 2008, entitled "Fluid Powered Motor and Pump," the entire contents of which are incorporated herein by this reference.

FIELD OF THE INVENTION

This invention relates to fluid-powered motors and pumps and more particularly, but not necessarily exclusively, to motors and pumps powered by (or powering) liquids such as water. The motors and pumps may be especially useful in connection with filtration systems for pools and spas, although they may be used in other ways as well.

BACKGROUND OF THE INVENTION

U.S. Pat. No. 4,449,265 to Hoy illustrates an example of a wheeled automatic swimming pool cleaner. Powering the wheels is an impeller comprising an impeller member and pairs of vanes. Evacuating the impeller causes water within a swimming pool to interact with the vanes, rotating the impeller member. The impeller is reversible, with the impeller member apparently moving laterally when the pool cleaner reaches an edge of a pool to effect the rotation reversal.

U.S. Pat. No. 6,292,970 to Rief, et al., describes a turbine-driven automatic pool cleaner. The cleaner includes a turbine housing defining a water-flow chamber in which a rotor is positioned. Also included are a series of vanes pivotally connected to the rotor. Water interacting with the vanes rotates the rotor in one direction (clockwise as illustrated in the Rief patent), with the vanes pivoting when encountering "debris of substantial size" to allow the debris to pass through the housing for collection. The contents of the Hoy and Rief patents are incorporated herein in their entireties by this reference.

SUMMARY OF THE INVENTION

The present invention provides efficient alternatives to conventional impellers and turbines. The invention also may be activated as a pump and, if desired, may switch between motor and pump functions dynamically. It has especial usefulness as a motor powering an automatic swimming pool cleaner, although the invention may be utilized in connection with other aspects of a filtration system for a pool or spa or as part of any other system in which conversion of energy from, for example, a suction or pressure source to rotational power is necessary or desired.

Currently-preferred versions of the present invention typically comprise a body having at least one inlet and at least one outlet. Within the body are positioned one or more pairs of paddles whose distal edges may, if desired, be locally flexible to facilitate passage of debris. Such local flexibility is not required, however. Rather than being placed in the same plane (or otherwise uniformly formed), however, paddles of a pair in the present invention may be positioned perpendicularly. Stated differently, if the paddles themselves are generally planar and one paddle of a pair exists in a first plane, the other paddle of the pair may exist in a second plane normal to the first plane. In other versions these paddles of a pair need not necessarily be perpendicular to each other, although some angular difference between orientations of paddles of a pair may be beneficial. In yet other versions, paddles need not necessarily be paired, although again having angular differences between orientations of various paddles may be advantageous.

In at least one version of the invention having paired paddles, a first pair of paddles is connected by a shaft. The paddles additionally are connected, via hinges, bearings, or other connection means, to a base. The base is configured to allow some rotation of the paddles about an axis aligned with at least part of the shaft, with the base and connection means also functioning to limit rotation of the paddles in some, but not all, versions of the invention. Preferably, the paddles may rotate through an angle of ninety degrees about this axis, although other angular rotations may occur instead.

At least this embodiment further includes a second pair of paddles likewise connected by a shaft and to a base. Each of the two shafts beneficially may be non-linear, allowing the shafts to cross without interfering with paddle rotation yet permitting portions of each shaft to remain in the same plane. Moreover, the two bases may be configured to fit together, forming a unitary structure housing at least parts of both shafts. Either or both bases may include an outwardly-extending shaft that provides (1) rotational output when the invention is used as a motor and (2) rotational input when the invention is used as a pump.

Bodies consistent with the invention may be hollow (or have hollow portions) into which the paddles and bases are fitted. The unitary structure including the paddles and bases may rotate about the outwardly-extending shaft (or shafts) a full three hundred sixty degrees (i.e. in paddle-wheel fashion) either clockwise or counter-clockwise as desired. Consequently, paddles of the present invention may rotate about two different axes in operation, although they preferably do not move linearly—unlike the impeller member of the Hoy patent.

The bodies also may be configured to present flow restrictions. Such a restriction may, when contacted by a paddle, cause the paddle to rotate so that its faces are parallel (or generally parallel) to the fluid direction through the body. This rotation in turn causes the paired paddle to rotate so that its faces are perpendicular to the flow direction. The result is one paddle of a pair presenting minimum surface area to the flow direction while the other provides maximum surface are to the flow direction, allowing the suction or pressure force to work with greatest efficiency in rotating the unitary structure to supply high-torque output.

Stated differently, the present invention uses predominantly surface-area differentials to cause rotary motion. The fluid-flow pressure encountered by both paddles of a pair is the same (or approximately so); one paddle merely presents a larger surface area to the fluid flow than does the other paddle. This concept differs significantly from that of standard impellers, which jet fluid at one side of an impeller to cause a pressure differential on sides of the blades, thus creating rotation to relieve the imbalance.

Moreover, in standard impellers, a blade opposite the one being impacted by the jetted fluid is moving fluid in a direction opposite the flow. In this sense, it is "dragging dead fluid" along, reducing the overall efficiency of the device. By contrast, no material level of such "dragging" occurs in connection with the present invention.

It thus is an optional, non-exclusive object of the present invention to provide fluid-powered devices that may be employed as motors or pumps (or both).

It is another optional, non-exclusive object of the present invention to provide fluid-powered devices using, predominantly or exclusively, surface-area differentials to cause rotary motion.

It is a further optional, non-exclusive object of the present invention to provide fluid-powered devices utilizing at least one pair of paddles, with each paddle of a pair being non-planar, or otherwise non-uniformly oriented, with the other paddle of the pair.

It is, moreover, an optional, non-exclusive object of the present invention to provide paddles configured to rotate about multiple axes.

It is also an optional, non-exclusive object of the present invention to provide fluid-powered devices having a pair of paddles connected via a non-linear shaft.

It is an additional optional, non-exclusive object of the present invention to provide fluid-powered devices especially useful in connection with automatic swimming pool cleaners or other equipment used as part of filtration systems of pools, spas, or hot tubs.

Other objects, features, and advantages of the present invention will be apparent to those skilled in appropriate fields with reference to the remaining text and the drawings of this application.

DETAILED DESCRIPTION

Figure 1:
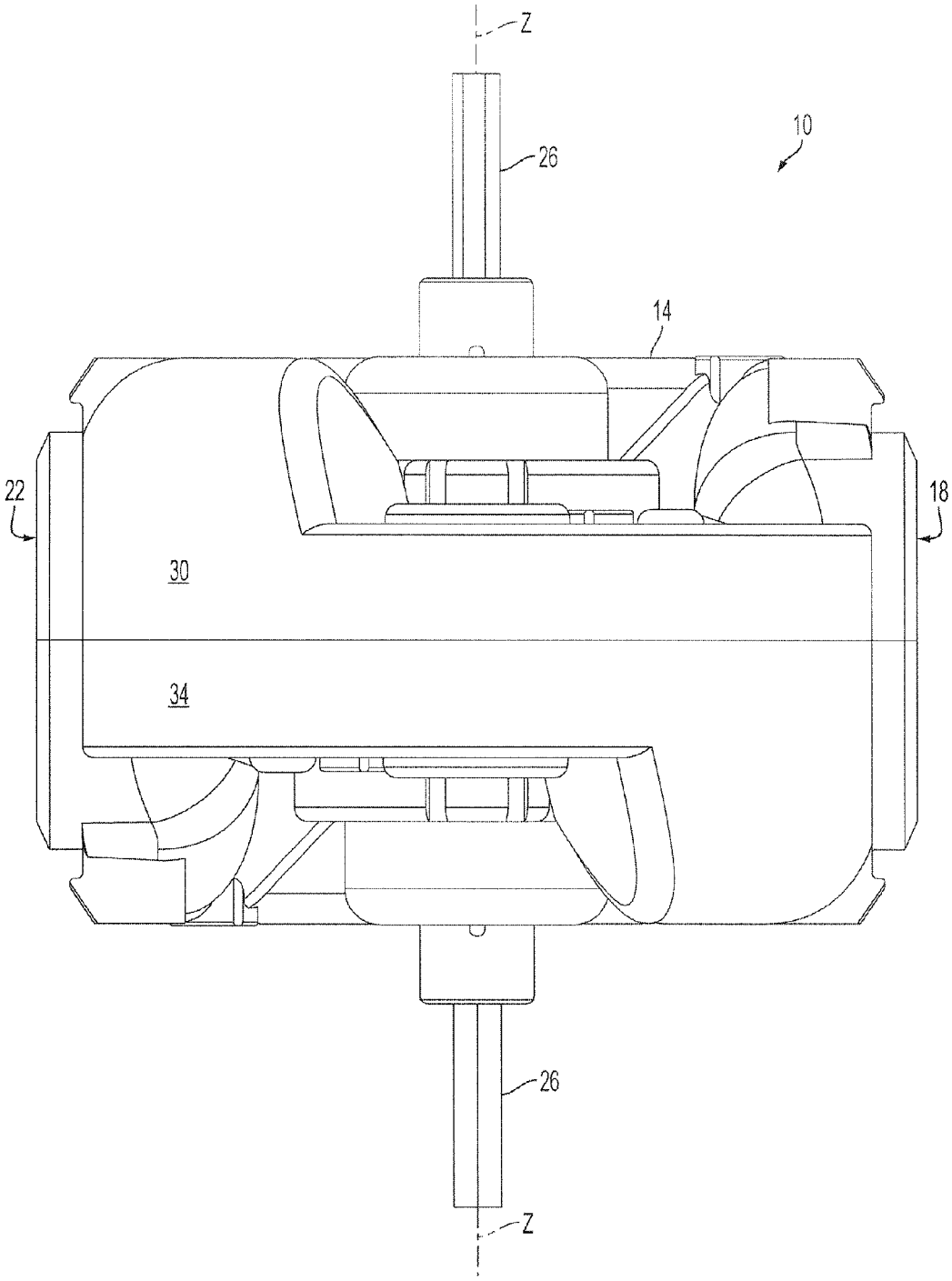
FIG. 1 is a first exterior plan view of an exemplary device consistent with the present invention.
Figure 2:
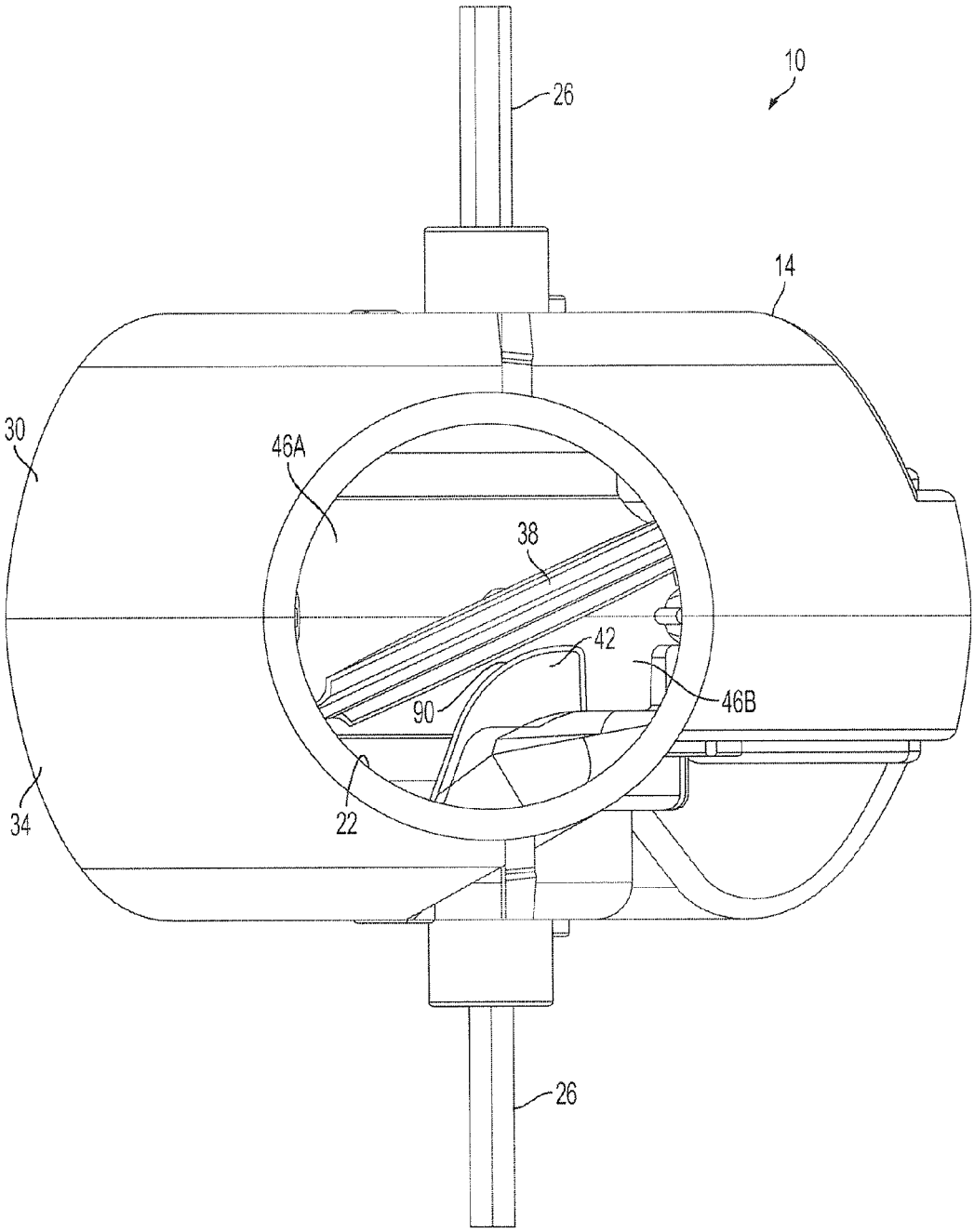
FIG. 2 is a second exterior plan view of the device of FIG. 1.

Depicted in FIGS. 1-2 is exemplary device 10. Device 10 may function as a motor or pump or as any other device configured to convert energy from a suction or pressure source to rotational movement. Device 10 may include body 14 defining inlet 18 and outlet 22 as well as outwardly-extending shafts 26. Although two such outwardly-extending shafts 26 are illustrated in FIGS. 1-2, more or fewer shafts 26 may be utilized instead. Likewise, although shafts 26 are shown in FIGS. 1-2 as being elongated rods, they may be configured or shaped differently than as shown.

Body 14 may, if desired, comprise at least first and second portions 30 and 34. If so, first and second portions 30 and 34 preferably are connected in use, as illustrated in FIGS. 1-2. At least part of body 14 additionally preferably (although not necessarily) is symmetric about both (1) the connection between first and second portions 30 and 34 and (2) an axis coincident with shafts 26. Fluid flow through body 14 may occur from inlet 18 to outlet 22 or from outlet 22 to inlet 18. Hence, the terms "inlet" and "outlet" of body 14 are used herein for convenience, as the "inlet" may at times be the outlet of body 14 and the "outlet" may at these times be the inlet of body 14.

Also depicted in FIGS. 1-2 as being within body 14 is an exemplary blade, vane, or paddle 38 as well as restriction 42 and hubs or bases 46A and 46B. Paddle 38, together with one or more similar paddles, may be connected directly or indirectly to outwardly-extending shafts 26. When device 10 is employed as a motor, fluid flowing through body 14 interacts with each paddle 38 to produce rotation of shafts 26.

Figure 3:
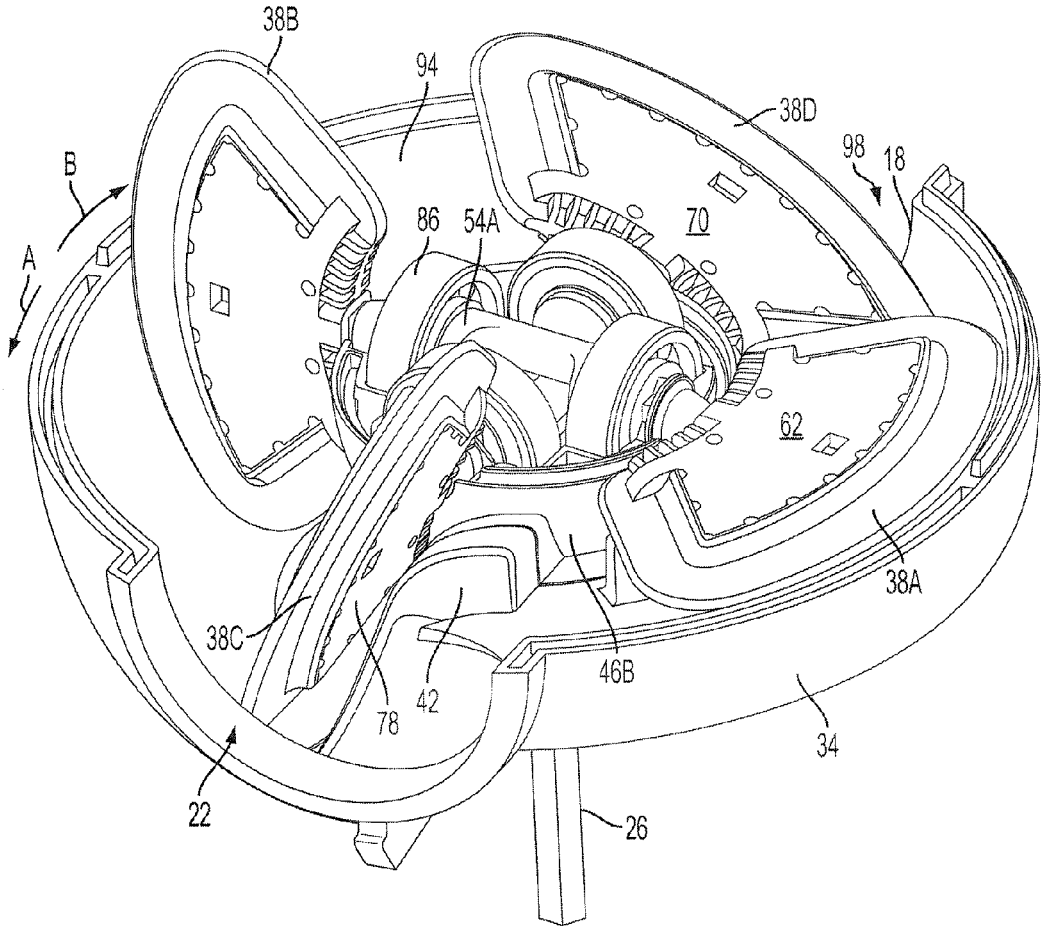
FIG. 3 is a first perspective view of portions of the device of FIG. 1, including two pairs of paddles and a flow restrictor depicted within a body.
Figure 4:
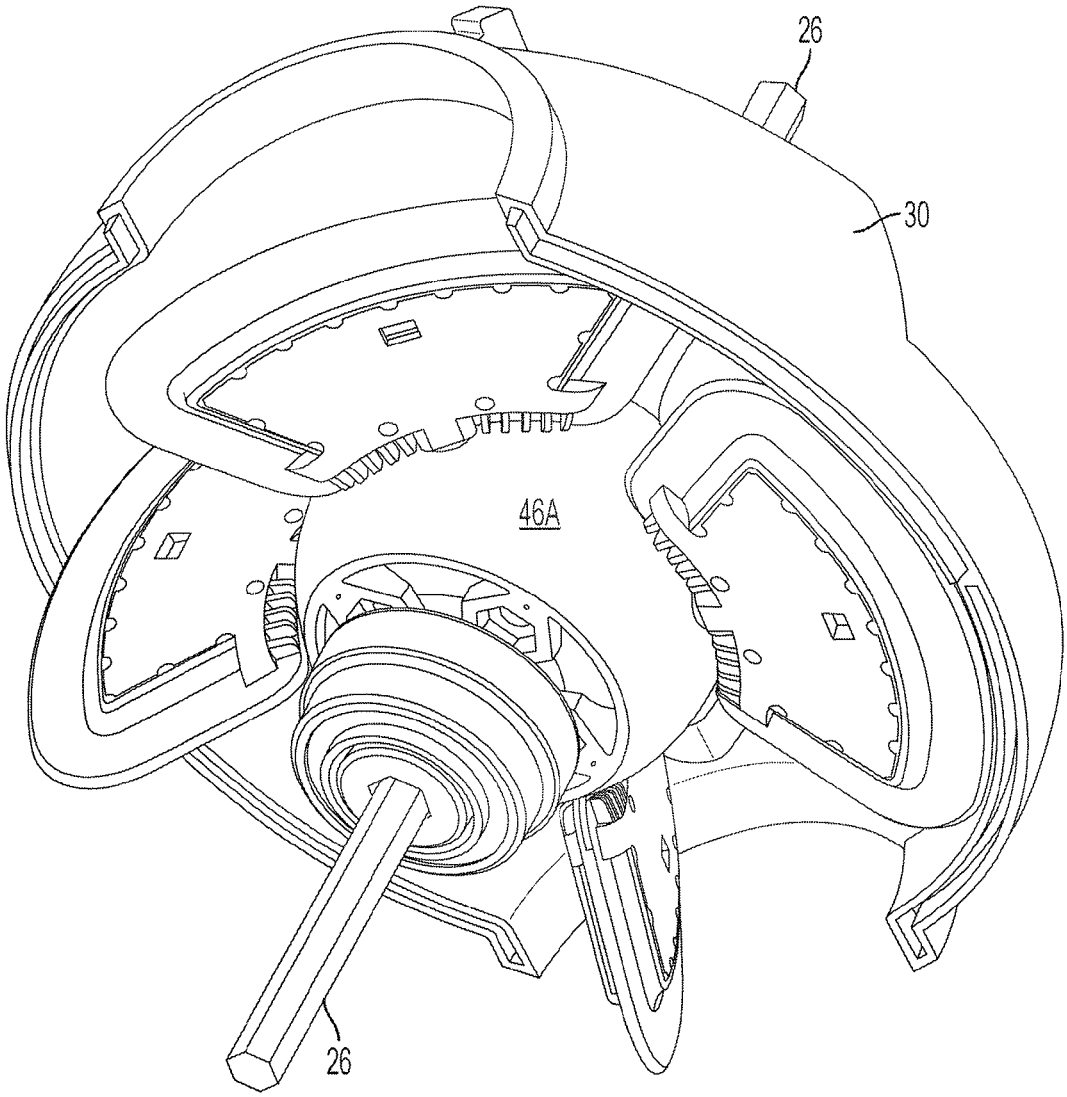
FIG. 4 is a second perspective view of portions of the device of FIG. 1, including the pairs of paddles of FIG. 3.
Figure 5:
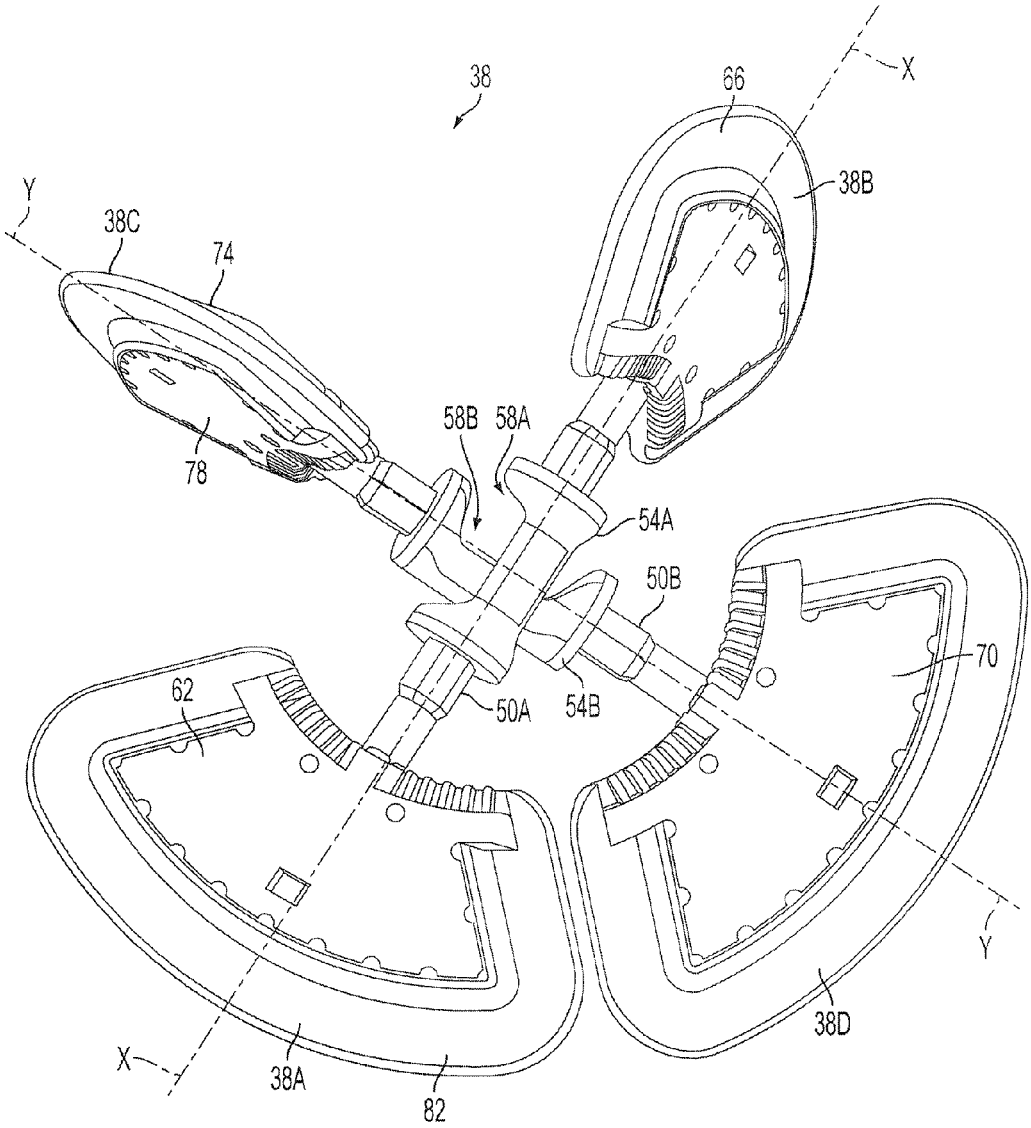
FIG. 5 is a perspective view of the pairs of paddles of FIG. 3.

FIGS. 3-5 depict multiple paddles 38. FIG. 5, in particular, illustrates that paddles 38 may, if desired, be paired; two such pairs are shown in the figure, with one pair comprising paddles 38A and 38B and the other pair comprising paddles 38C and 38D. In presently-preferred versions of device 10, paddles 38A and 38B are connected by shaft 50A and paddles 38C and 38D are connected by shaft 50B. Preferably no direct connection exists between paddles 38A and 38B, on the one hand, and paddles 38C and 38D, on the other hand. Instead, shafts 50A and 50B are configured to cross in a manner avoiding interference by shaft 50A with rotation of paddles 38C and 38D and by shaft 50B with rotation of paddles 38A and 38B. Although device 10 preferably includes four paddles 38 (e.g. paddles 38A, 38B, 38C, and 38D), more or fewer paddles 38 may be used.

In a version of paddles 38 depicted in FIGS. 3-5, shaft 50A resembles an elongated cylinder and thus may define a generally longitudinal axis X. Shaft 50B is similar, defining a generally longitudinal axis Y. Central portion 54A of shaft 50A, however, deviates from axis X, essentially being shifted laterally from the axis X to form nesting space 58A. Likewise, central portion 54B of shaft 50B is translated from axis Y to form nesting space 58B. Shaft 50A thus may be placed generally in the same plane as shaft 50B, with nesting spaces 58A and 58B being adjacent. In the version shown in FIG. 5, central portion 54A is atop central portion 54B but not in contact therewith because of the alignment of nesting spaces 58A and 58B.

FIG. 5 additionally illustrates a preferred relative orientation of paddles 38 of a pair. Paddle 38A, for example, is shown in FIG. 5 as having a principal face 62 (together with its opposite face, which is not shown) generally in the plane of the page. By contrast, paddle 38B is depicted as having its principal and opposite face 66 (as well as its unshown opposite face) generally normal to the plane of the page. Stated differently, a plane containing principal face 62 and passing through axis X preferably is perpendicular to a plane containing principal face 66 and passing through axis X, so that principal faces 62 and 66 are offset by ninety degrees. Accordingly, when principal face 62 presents maximum surface area to the flow direction through body 14, principal face 66 will present minimum surface area to the flow direction. Relative orientation of paddles 38C and 38D preferably is similar; a plane containing principal face 70 of paddle 38D passing through axis Y may be perpendicular to a plane containing principal and opposite faces 74 and 78, respectively, of paddle 38C passing through the axis Y.

Although relative faces of pairs of paddles 38 preferably are offset by ninety degrees, this exact angular orientation is not mandatory. Angular offset should be greater than zero for paddles 38 of a pair; thus the invention contemplates any other such offset. Nevertheless, offsets greater than, for example, five, twenty, or forty-five degrees may be necessary to produce satisfactory results in many cases. Because preferred versions of shafts 50A and 50B and faces 62, 66, 70, 74, and 78 (etc.) are inflexible, paddles 38A and 38B will retain their angular offset at all times, while paddles 38C and 38D likewise will retain their angular offset at all times. If desired, however, paddle edges (such as edge 82 of paddle 38A) may be flexible to facilitate passage of debris through body 14 or reduce frictional wear of paddles 38 (or of body 14).

Shafts 50A and 50B, together with bearings-containing wheels 86, may be placed in base 46B as illustrated in FIG. 3. Base 46A (FIG. 4) may be fitted over wheels 86 and attached to base 46A. The resulting structure permits shafts 50A and 50B and associated paddles 38A-D to rotate about axis Z coincident with shafts 26. When device 10 functions as a motor, rotation about axis Z occurs because of fluid flow through body 14; if fluid enters via inlet 18, rotation will be in the direction of arrow A (see FIG. 3). Conversely, if fluid enters via outlet 22, rotation will be in the opposite direction, as shown by arrow B. (Alternatively, restriction 42 may be repositioned appropriately within body 14 to reverse rotational direction without changing whether fluid enters via inlet 18 or outlet 22.) Because shafts 26 are connected to the rotating components, they too will rotate, providing power available to perform useful work.

In use, paddles 38 rotate about another axis as well. Paddles 38A-B, for example, may rotate about axis X, while paddles 38C-D may rotate about axis Y. This second type of rotation is caused by restrictor 42.

Assume, for example, that paddles 38A-D are configured and oriented as shown in FIG. 3 and rotating in the direction of arrow A. Paddle 38C is generally vertical in this example as it approaches restrictor 42, which is shown as being in the form of a ramp. Further movement in the direction of arrow A causes face 78 of paddle 38C to contact restrictor 42, whose sloping surface 90 (see also FIG. 2) forces paddle 38C to rotate about axis Y so as to reorient generally horizontally (with its face 74 ultimately facing upward like face 62 in FIG. 3). As paddle 38C rotates from a generally vertical position to a generally horizontal one, paired paddle 38D will rotate from a generally horizontal position to a generally vertical one. Indeed, this relationship is illustrated in FIG. 3 by paired paddles 38A and 38B: Paddle 38A has already been forced by restrictor 42 into a generally horizontal orientation, causing paired paddle 38B to assume a generally vertical orientation.

Continuing this example consistent with FIG. 3, fluid entering inlet 18 may travel to outlet 22 via either side of base 46B—i.e. through both channel 94 and channel 98. (Preferably, however, channel 98 is substantially more restricted than channel 94, so that only limited flow occurs therethrough.) The fluid entering inlet 18 initially encounters paddle 38D. Because paddle 38D is generally horizontal, it presents minimal surface area to the direction of fluid flow from inlet 18 to outlet 22. This result additionally is true for paddle 38A, having been forced to the horizontal position by restriction 42 (and in effect sealing, or substantially sealing, channel 98). By contrast, paddle 38B is generally vertical, presenting maximum surface area (in the form of face 66, which is not shown in FIG. 3 but is depicted in FIG. 5) to the fluid flow direction. This differential surface area causes the flowing fluid to push on paddle 38B, resulting in paddle rotation in the direction of arrow A.

Although not illustrated in FIG. 3, restrictor 42 may continue throughout channel 98 or otherwise have a sloping surface adjacent inlet 18, so that device 10 may be operated in reverse. Further, if power is supplied to rotate one or more shafts 26, the shafts 26 in turn may rotate paddles 38 about axis Z so that device 10 may function as a fluid pump, in this sense being fluid "powered" in its operation regardless of how shafts 26 are caused to rotate. As a consequence, device 10 provides a versatile, efficient mechanism for using flowing fluid to create rotation.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. An assembly comprising:

a. a body (i) through which fluid may flow, (ii) defining a generally circular cross-section, and (iii) having an inlet and an outlet spaced approximately 180° across the generally circular cross-section;

b. a rotatable first paddle (i) positioned at least partly within the body and (ii) comprising a face and a flexible edge;

c. rotatable second paddle positioned at least partly within the body, comprising a face, and configured so that, (i) when the face of the first paddle rotates about a first axis to encounter fluid at a first angle thereto, the face of the second paddle rotates about the first axis to encounter fluid at a second angle thereto, the first and second angles differing by approximately 90°, and (ii) when the first paddle is adjacent the inlet, the second paddle is adjacent the outlet;

d. a first shaft (i) connecting the first and second paddles, (ii) comprising a first nesting space, and (iii) defining the first axis about which the first and second paddles are configured to rotate;

e. a rotatable third paddle (i) positioned at least partly within the body and (ii) comprising a face;

f. a rotatable fourth paddle positioned at least partly within the body, comprising a face, and configured so that, (i) when the face of the third paddle rotates about a second axis to encounter fluid at a third angle thereto, the face of the fourth paddle rotates about the second axis to encounter fluid at a fourth angle thereto, the third and fourth angles differing by approximately 90°, and (ii) when the third paddle is adjacent the inlet, the fourth paddle is adjacent the outlet;

g. a second shaft (i) connecting the third and fourth paddles, (ii) comprising a second nesting space configured for alignment with the first nesting space, and (iii) defining the second axis about which the third and fourth paddles are configured to rotate;

h. a third shaft extending outwardly from the body and defining a third axis about which the first, second, third, and fourth paddles are configured to rotate; and i. a restriction positioned at least partly within the body and configured to contact at least (i) the first paddle and thereby cause it to rotate about the first axis and (ii) the third paddle and thereby cause it to rotate about the second axis.

2. An assembly according to claim 1 further comprising an automatic cleaner configured to move within a pool or spa.

* * * * *